US009933227B2

(12) United States Patent
Ollig

(10) Patent No.: US 9,933,227 B2
(45) Date of Patent: Apr. 3, 2018

(54) TRIGGER SIMULATION DEVICE

(71) Applicant: Daniel Mark Ollig, Dassel, MN (US)

(72) Inventor: Daniel Mark Ollig, Dassel, MN (US)

( * ) Notice: Subject to any disclaimer, the term of this patent is extended or adjusted under 35 U.S.C. 154(b) by 262 days.

(21) Appl. No.: 15/058,591

(22) Filed: Mar. 2, 2016

(65) Prior Publication Data

US 2016/0258706 A1 Sep. 8, 2016

Related U.S. Application Data

(60) Provisional application No. 62/129,560, filed on Mar. 6, 2015.

(51) Int. Cl.
*F41A 33/00* (2006.01)
*F41A 19/10* (2006.01)

(52) U.S. Cl.
CPC ..... *F41A 33/00* (2013.01); *F41A 19/10* (2013.01)

(58) Field of Classification Search
USPC ..... 434/11, 16, 18; 446/23, 401, 405, 406, 446/473
See application file for complete search history.

(56) References Cited

U.S. PATENT DOCUMENTS 4,539,889 A 9/1985 Glock
6,086,375 A * 7/2000 Legros ..... F41A 31/00 434/11
8,684,737 B1 * 4/2014 Jordan ..... F41A 33/00 434/16
9,182,189 B2 11/2015 Seigler
9,739,557 B2 * 8/2017 Lee ..... F41A 19/12
9,803,948 B2 * 10/2017 Liao ..... F41A 33/00
2006/0101693 A1 * 5/2006 Langlotz ..... F41A 19/16 42/69.01
2011/0047847 A1 * 3/2011 Hughes ..... F41A 19/16 42/1.01
2011/0306020 A1 * 12/2011 Peterson ..... F41A 33/06 434/18
2012/0015781 A1 * 1/2012 Limonadi ..... A63B 21/00061 482/44
2015/0300766 A1 * 10/2015 Sims ..... F41A 33/00 434/16
2016/0169608 A1 * 6/2016 Schulz ..... F41A 33/02 434/22

OTHER PUBLICATIONS

"Reset Trigger Kit for Glock," available at , <<http://www.glockstore.com/Reset-Trigger-Kit-for-Glock>>, Glockstore.com, San Diego, CA, retrieved on Oct. 26, 2016, 3 pages.

* cited by examiner

*Primary Examiner* — Kurt Fernstrom
(74) *Attorney, Agent, or Firm* — Todd R. Fronek; Larkin Hoffman Daly & Lindgren, Ltd.

(57) ABSTRACT

A device is disclosed that is used temporarily to replace a trigger assembly of a weapon. In one embodiment, the device is self-resetting, including a biasing mechanism to reset a trigger lever to a firing position. As such, the feel of depressing a cocked trigger with each simulated trigger pull is simulated. This device allows the user to experience a more realistic dry fire training session, allowing the user to still cycle the gun action normally if they choose.

12 Claims, 4 Drawing Sheets

TRIGGER SIMULATION DEVICE

CROSS-REFERENCE TO RELATED APPLICATIONS

This application claims the benefit of U.S. Provisional Application No. 62/129,560 filed Mar. 6, 2015.

BACKGROUND

Dry firing is a training method commonly used for weapon training that simulates a weapon's action. The object of dry fire training is to practice trigger control and other weapons manipulation techniques without using live ammunition. For example, AR15, AR10, M4 and M16 and similarly patterned weapons are single action weapons. For the trigger to release the hammer to strike the firing pin, the action must be cycled to reset or cock the firing mechanism. This cycling is normally done automatically by virtue of the weapon action's normal cycle from firing live ammunition. During dry fire practice, however, current simulation devices require the user to manually work the action to reset the trigger and hammer each time before the trigger can be depressed. This reset is inconsistent with live ammunition fire and thus not desirable for training.

SUMMARY

A device is disclosed that is used temporarily to replace a trigger assembly of a weapon. In one embodiment, the device is self-resetting, including a biasing mechanism to reset a trigger lever to a firing position. As such, the feel of depressing a cocked trigger with each simulated trigger pull is simulated. This device allows the user to experience a more realistic dry fire training session, allowing the user to still cycle the gun action normally if they choose.

DETAILED DESCRIPTION

Figure 1:
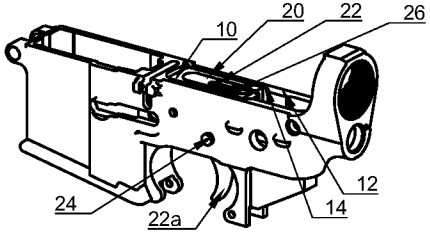
FIG. 1 is a top, perspective view of a trigger simulation device positioned within a lower portion of a weapon.

FIG. 1 is a top, perspective view of a trigger simulation device 10 positioned within a weapon 12 (e.g., an AR15). In particular, the device 10 is positioned within a cavity 14 of the weapon 12, wherein the trigger assembly (not shown) of the weapon 12 has been removed and device 10 has been inserted in its place. The device 10 includes a support block 20 and a trigger lever 22 movable with respect to the support block 20. Upon final assembly, the trigger lever 22 extends to a position accessible by a user, particularly including a lower trigger portion 22*a* configured to engage a finger of a user. In particular, the device 10 locates the trigger portion 22*a* in a firing position. When applying pressure to the trigger portion 22*a*, the lever 22 rotates from the firing position about a pivot pin 24 to an extended position. Upon release of the trigger portion 22*a* when the lever 22 is in the extended position, a biasing mechanism 26 (e.g., a tension spring) operates to return the lever 22 to the firing position.

Figure 2:
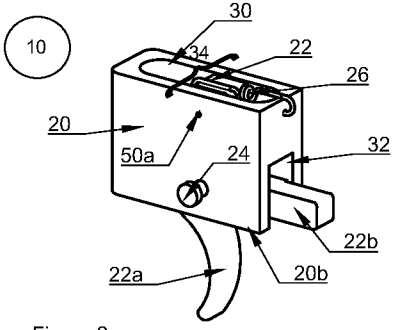
FIG. 2 is a side, perspective view of a trigger simulation device.
Figure 3:
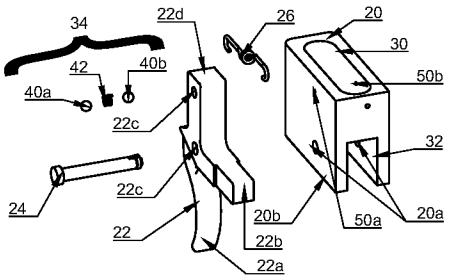
FIG. 3 is an exploded view of the device of FIG. 2.

FIGS. 2-3 illustrate the device 10 in more detail. As illustrated, the support block 20 is substantially rectangular in shape and includes an elongated slot 30 extending vertically through the block 20 to accommodate the trigger lever 22*b* and a transverse slot 32 accommodating a safety interface portion 22*b* of the trigger lever 22 from the firing position to the extended position. Movement of the lever 22 is controlled via the pivot pin 24 and a retaining assembly 34. In particular, the pivot pin 24 defines an axis of rotation for trigger lever 22 and the retaining assembly 34 defines a pressure threshold wherein, for rotational force on the trigger portion 22*a* below the threshold, the trigger lever 22 remains in the firing position. In particular, the retention assembly 34 engages a retention portion 50 of support block 20 when in the firing position. To that end, the retention assembly 34, in one embodiment, defines means for retaining the lever 22 in the firing position. When rotational force on the trigger portion 22*a* exceeds the predetermined threshold, the lever 22 is released from the firing position and further rotational movement allows transition to the extended position. Various features of the device 10 can be selected to establish a level of the predetermined threshold.

The firing position can be defined as the position of lever 22 wherein the retaining assembly 34 engages retention portion 50 and safety interface portion 22*b* is generally parallel to a lower edge 20*b* of block 20. The extended position can be defined as the position of lever 22 with respect to block 20 wherein safety interface portion 22*b* contacts a safety cam lever (not shown) or other portion of weapon 14. Contact between the safety interface portion 22*b* and the cam lever prevents further rotational movement of trigger lever 22 with respect to block 20. Based on the above, movement of trigger lever 22 relative to block 20 can be defined as including the firing position, wherein rotational movement of the lever 22 is prevented based on rotational forces 22 placed on trigger portion 22*a* below a predetermined threshold. When rotational force on trigger portion 22*a* is above the predetermined threshold, the lever 22 releases from the firing position. Further rotational force allows the lever 22 to further transition through intermediate positions to the extended position, wherein safety interface portion 22*b* contacts the cam lever. Between the firing position (i.e., in the intermediate positions), and the extended position, in one embodiment, forces below the predetermined threshold allow rotation of the lever 22 relative to the block 20. Biasing mechanism 26 can include a spring constant that is sufficient to rotate lever 22 to the firing position (from the extended position or intermediate positions) upon release of the user's finger from the trigger portion 22*a*. In one embodiment, the biasing mechanism 26 can be referenced as biasing means for returning the lever 22 to the firing position.

The pivot pin 24 extends through apertures 20*a* in the block 20 positioned on either side of slot 30 and an aperture 22*c* within the lever 22 to control rotation of the lever 22 with respect to the block 20 about a central axis of the pivot pin 24. The retaining assembly 34 interfaces between an extension portion 22*d* of the lever 22 and mounting block 20 to simulate pressure applied to a trigger in a normal firing situation. From the firing position, upon rotation of the lever 22 with respect to the block 20 in excess of the predetermined level, the retaining assembly 34 releases from engagement with the block 20 and the lever 22 is able to rotate within the block to the extended position.

The retaining assembly 34 includes a pair of ball bearings 40*a*, 40*b* positioned on either side of a biasing mechanism 42. The ball bearings 40*a*, 40*b* and biasing mechanism 42 are located within an aperture 22*e* in the extension portion 22*d* of the trigger lever 22. In one embodiment, bearings 40*a*, 40*b* are larger in diameter than a retention portion 50 (formed of corresponding apertures 50*a*, 50*b*) formed within the block 20. Together, the apertures 50*a*, 50*b* form a retention portion of the support block 20. The relative size of the bearings 40*a*, 40*b* and apertures 50*a*, 50*b*, the vertical position of bearings 40*a*, 40*b* on trigger lever 22 and block 20 may be changed to create a different feel to the action of the device 10. In one embodiment, bearings 40*a*, 40*b* are made out of plastic, resin or other suitable material instead of metal. Biasing mechanism 42 sits in between bearings 40*a*, 40*b*, whose function is to provide bias to both bearings 40*a*, 40*b* that push on block 20, and seat in apertures 50*a*, 50*b*. Features such as spring weight, number of coils, overall diameter, distance between apertures 22*c* and 22*e*, or other features may be changes to provide a different feel to the action of the device 10. In a further embodiment, the retention portion so can take various forms such as depressions or recesses.

Upon final assembly and when trigger lever 22 is in the firing position, biasing mechanism 42 locks bearings 40*a*, 40*b* into apertures 50*a*, 50*b*. Due to rotation of trigger lever 22, bearings 40*a*, 40*b* are forced into aperture 22*e* due to interface between surfaces of slot 30 and the bearings 40*a*, 40*b*. When pressure is sufficient so as to force bearings 40*a*, 40*b* to release from apertures 50*a*, 50*b*, lever 22 can rotate more freely.

In one example, the support block 20 is machined from a solid piece of metal, plastic, resin or other suitable material to be hollowed to accommodate the trigger lever 22. Pivot pin 24 serves to not only provide a pivot point for trigger lever 22 to pivot on, but serves to locate and secure the device 10 within the lower receiver of the weapon 14 though existing apertures in the weapon 12. In one example, pivot pin 24 is made of metal, plastic or resin and may include a flat head on one side with an expanding anchor on the other.

In one example, trigger lever 22 can be made from formed plastic, resin, metal, or other suitable material and colored to a bright safety color. The lever includes the trigger portion 22*a*, safety interface 22*b* extending orthogonal to the trigger portion 22*a* and extension portion 22*d* extending opposite the trigger portion 22*a*. Safety interface 22*b* is a projection of the trigger lever 22 that makes contact with a safety cam lever (not shown) of weapon 14. As such, the device 10 allows a safety switch of the weapon 14 to operate normally.

Figure 4:
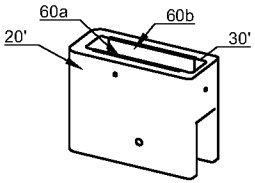
FIG. 4 is a side, perspective view of an alternative support block of for use with a trigger simulation device.

In an alternative embodiment illustrated in FIG. 4, an alternative block 20' includes a slot 30' that includes plates 60*a* and 60*b* provided on either side of the slot 30'. These plates 60*a* and 60*b* can be formed of a variety of materials so as to prevent surfaces of the slot 30' from wear. Example materials for plates 60*a* and 60*b* include metal, plastic and the like. The plates 60*a* and 60*b* can be coupled to the slot 30' using an adhesive or other attachment structure. In one embodiment, grooves (not shown) can be formed in a surface of the slot 30' to receive the adhesive.

Various embodiments of the invention have been described above for purposes of illustrating the details thereof and to enable one of ordinary skill in the art to make and use the invention. The details and features of the disclosed embodiment[s] are not intended to be limiting, as many variations and modifications will be readily apparent to those of skill in the art. Accordingly, the scope of the present disclosure is intended to be interpreted broadly and to include all variations and modifications coming within the scope and spirit of the appended claims and their legal equivalents.

The invention claimed is:

1. A trigger simulation device, comprising:

a support block defining a retention portion;

a trigger lever positioned within the support block for rotation about an axis with respect to the support block from a firing position to an extended position; and a retention assembly coupled with the support block and trigger lever, the retention assembly engaging the retention portion when the trigger lever is in the firing position, wherein, upon a rotational force placed on the trigger lever in excess of a predetermined threshold, the retention assembly member is released from the retention portion such that, when released from the firing position, rotational force less than the predetermined threshold allows rotation of the trigger lever relative to the block.

2. The device of claim 1, wherein the trigger lever includes a trigger portion, an extension portion and a safety interface portion.

3. The device of claim 2, wherein the support block defines a vertical slot to accommodate rotation of the trigger lever and a transverse slot to accommodate the safety interface portion.

4. The device of claim 1, wherein the extended position is defined as the safety interface portion contacting a portion of an associated weapon coupled with the device.

5. The device of claim 1, further comprising a biasing mechanism configured to bias the trigger lever to the firing position with respect to the support block when a rotational force is removed from the trigger portion.

6. The device of claim 1, wherein the retention assembly includes opposed ball bearings positioned on either side of a biasing mechanism, the ball bearings positioned within the retention portion in the support block when the trigger lever is in the firing position.

7. A trigger simulation training device, comprising:

a support block;

a trigger lever;

means for retaining the trigger lever in a firing position.

8. The device of claim 7, wherein the trigger lever includes a trigger portion, an extension portion and a safety interface portion.

9. The device of claim 8, wherein the support block defines a vertical slot to accommodate rotation of the trigger lever and a transverse slot to accommodate the safety interface portion.

10. The device of claim 9, wherein the lever can be rotated to an extended position that is defined as the safety interface portion contacting a portion of an associated weapon coupled with the device.

11. The device of claim 7, further comprising biasing means for returning the trigger lever to the firing position when a rotational force is removed from the trigger portion.

12. The device of claim 7, wherein the means for retaining include opposed ball bearings positioned on either side of a biasing mechanism, the ball bearings positioned within a retention portion in the support block when the trigger lever is in the firing position.

* * * * *